US008596443B2

(12) United States Patent
Brügmann

(10) Patent No.: US 8,596,443 B2
(45) Date of Patent: Dec. 3, 2013

(54) GOODS FEEDING SYSTEM FOR RECEIVING AND PRESENTING GOODS

(75) Inventor: Lars Brügmann, Hagen (DE)

(73) Assignee: Dirk A. Brugmann Kunststoffverarbeitung GmbH & Co. KG (DE)

( * ) Notice: Subject to any disclaimer, the term of this patent is extended or adjusted under 35 U.S.C. 154(b) by 47 days.

(21) Appl. No.: 13/400,160

(22) Filed: Feb. 20, 2012

(65) Prior Publication Data

US 2012/0211327 A1 Aug. 23, 2012

(30) Foreign Application Priority Data

Feb. 23, 2011 (DE) ..... 10 2011 012 219

(51) Int. Cl.
*B65G 13/00* (2006.01)

(52) U.S. Cl.
USPC ..... 193/35 TE; 193/35 R; 211/172

(58) Field of Classification Search
USPC ..... 193/3, 4, 35 R, 35 TE; 211/151, 153, 172
See application file for complete search history.

(56) References Cited

U.S. PATENT DOCUMENTS

| | | | | |
|---|---|---|---|---|
| 3,181,676 | A * | 5/1965 | Hire | 193/35 TE |
| 5,121,681 | A * | 6/1992 | Chang | 211/42 |
| 5,673,801 | A | 10/1997 | Markson | 211/59.3 |
| 6,089,385 | A | 7/2000 | Nozawa | 211/59.2 |
| 6,648,573 | B1 * | 11/2003 | Davison | 193/35 A |
| 6,675,946 | B2 * | 1/2004 | Lutz | 193/35 TE |
| 7,090,064 | B2 * | 8/2006 | Lutz | 193/35 R |
| 2006/0032827 | A1 | 2/2006 | Phoy | 211/59.2 |
| 2006/0032830 | A1 * | 2/2006 | Engel | 211/187 |
| 2006/0196842 | A1 * | 9/2006 | Taylor et al. | 211/186 |
| 2009/0223916 | A1 | 9/2009 | Kahl et al. | 211/85.4 |
| 2012/0186192 | A1 * | 7/2012 | Toebes et al. | 414/331.04 |

FOREIGN PATENT DOCUMENTS

| | | | |
|---|---|---|---|
| WO | WO99/30597 | 6/1999 | A47F 5/12 |

* cited by examiner

*Primary Examiner* — James R Bidwell
(74) *Attorney, Agent, or Firm* — Kusner & Jaffe

(57) ABSTRACT

This invention relates to a goods feeding system for receiving and presenting goods and for receiving goods feeding attachments for automatic forwarding of goods in a goods feeding direction W with a support surface for receiving and holding goods feeding attachments, whereby the goods feeding system has a support surface length (L) along the goods feeding direction (W), and the support surface can be pulled out at least partially along the support surface length (L) in the goods feeding direction (W).

15 Claims, 6 Drawing Sheets

GOODS FEEDING SYSTEM FOR RECEIVING AND PRESENTING GOODS

FIELD OF THE INVENTION

The invention relates to a goods feeding system for receiving and presenting goods and for receiving goods feeding attachments for automatic forwarding of goods in a goods feeding direction W. Goods feeding attachments according to the invention are described in DE 10 2010 006 746.6 and are to be regarded as disclosed in combination with this invention.

BACKGROUND OF THE INVENTION

Both in retail and wholesale businesses, such as, for example, drugstores, groceries, discount stores, toy stores, and the like, frames for storing and displaying products are necessary. When displaying and even storing the product, it is desired that the respective product lie on the frame bottom on the front side, aligned as much as possible with the adjacent products, so that the product is easily visible and accessible to the consumer and the arrangement of the products is aesthetically pleasing. To achieve such an arrangement of the products, known systems comprise the use of a push system to move the respective product or the rows of products in the direction of the front side of the frame when the product in front is removed or products are back-filled.

To separate adjacent rows of products, separation plates can be provided.

Such a goods feeding system is shown in, for example, WO 2009/097655 A1, which consists of a number of goods feeding attachments, consisting of an inner housing accommodating a roller and an outer housing receiving the inner housing, and two end caps that can be stacked in front of and behind the outer housing, which according to FIG. 7 are mounted on a carrier in an inclined arrangement. The goods are fed by tilting, i.e., without mechanical or electrical expenditure of energy/energy use, namely solely by the weight.

The object of this invention is to simplify the filling of the goods feeding system and at the same time to provide a goods feeding system, with which several goods can be presented with the same frame dimensions.

SUMMARY OF THE INVENTION

This object is achieved with the features of Claim 1. Advantageous further developments of the invention are indicated in the subclaims, and all combinations that consist of at least two of the features that are indicated in the specification, the claims and/or the figures also fall within the scope of the invention. At the indicated ranges of values, values that are within the above-mentioned limits are also to be regarded as disclosed as boundary values.

The basic idea of this invention is to fasten the goods feeding attachments to a support surface for automatic forwarding of the goods in such a way that the goods feeding attachments, assembled in particular in groups, can be pulled out from the support surface almost over the entire length L of the support surface. The placing of goods is significantly simplified by the fact that they can be pulled out.

This is therefore especially important since when newer products are brought in, the inventory that is still present in the frame does not have to be pushed through toward the rear. The products are to be removed according to the first-in first-out principle, and this invention simplifies the filling of the frames in such a way that when the support surface is being filled in the pulled-out state, the rear area of the support surface that is otherwise difficult to access can be reached more easily, namely even when even more products are present on the goods feeding attachment. Thus, the frame surfaces can be filled continuously, so that emptying of certain goods can be avoided to a large extent. The frames always appear full, and all goods are arranged flush with the frame front. In addition, smaller distances are possible between the compartments, so that more goods can be placed in a frame.

By a number of support surfaces being provided, which can be pulled out independently of one another, the manageability of the goods feeding system is facilitated. In any case, with support surfaces that are at least partially filled along a frame width, a considerable weight of the goods results. In addition, the danger of goods falling out is minimized.

According to an advantageous embodiment, it is provided that the support surfaces are designed in such a way that between adjacent support surfaces, a goods feeding attachment can be accommodated. This measure is conducive to a standardization of support surfaces since various frame widths can be equipped in a flexible manner owing to the modular design of the support surfaces, in particular with identically designed support surfaces.

According to another advantageous embodiment, it is provided that the support surface on the support surface side has at least one, in particular two, profiling(s) for attaching the goods feeding attachments, in particular exclusively, in a direction Q that is crosswise to the goods feeding direction W. By the profiling, the insertion of the goods feeding attachments is most simply implemented in modular design and can be integrated in the existing frame system.

Advantageously, it is provided according to the invention that the support surface on one of the guide sides that faces away from the support surface side has at least one guide groove, formed in particular by the profiling, for receiving and guiding at least one corresponding guide rail in the goods feeding direction W.

The profiling is further improved according to the invention by the profiling being designed in a U shape that is integral with the support surface that extends in particular along the goods feeding direction W over at least half, and preferably the whole, support surface length L. This has the advantage of a stable configuration and a modular insertable support surface that can be produced in the simplest way.

If a number of support surfaces, in particular in each case by means of the guide rails, can be mounted in a profile groove, running in crosswise direction Q, of a carrier profile with an angle of inclination $\alpha$, the mounting of the goods feeding system is further optimized.

In this respect, the invention is further developed by several adjacent goods feeding attachments and/or several adjacent support surfaces being connected by a section bar to a group. In this way, groups of support surfaces that are supported in particular according to product groups can be formed in the simplest way.

This embodiment can be further optimized by the section bar being arranged at the end of the support surface that lies in the goods feeding direction W and by a stop that projects from the support surface side being clipped onto the latter.

In another advantageous embodiment of the invention, it is advantageously provided that the support surface can be locked in an insertion position, in particular by at least one detent that is preferably provided at the guide rail. In this respect, an inadvertent pulling-out of the support surface, for example in the case of a customer removing goods, is prevented.

Other advantages, features and details of the invention follow from the following description of preferred embodiments and based on the drawings.

DETAILED DESCRIPTION OF PREFERRED EMBODIMENT

In the figures, the same elements or elements that have the same effect are identified with the same reference numbers.

Figure 1:
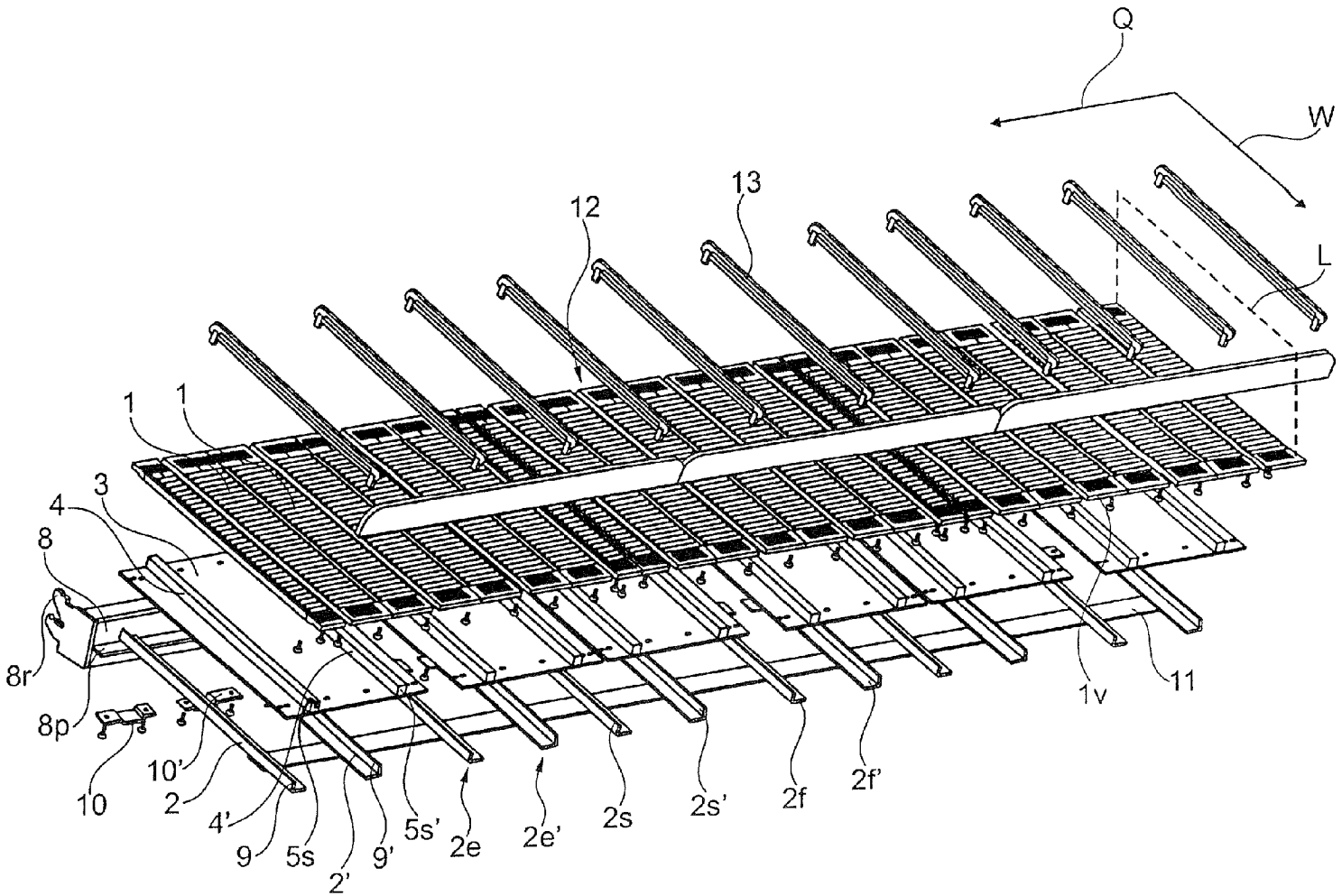
FIG. 1 shows a perspective exploded view of a goods feeding system according to the invention obliquely from above.
Figure 2:
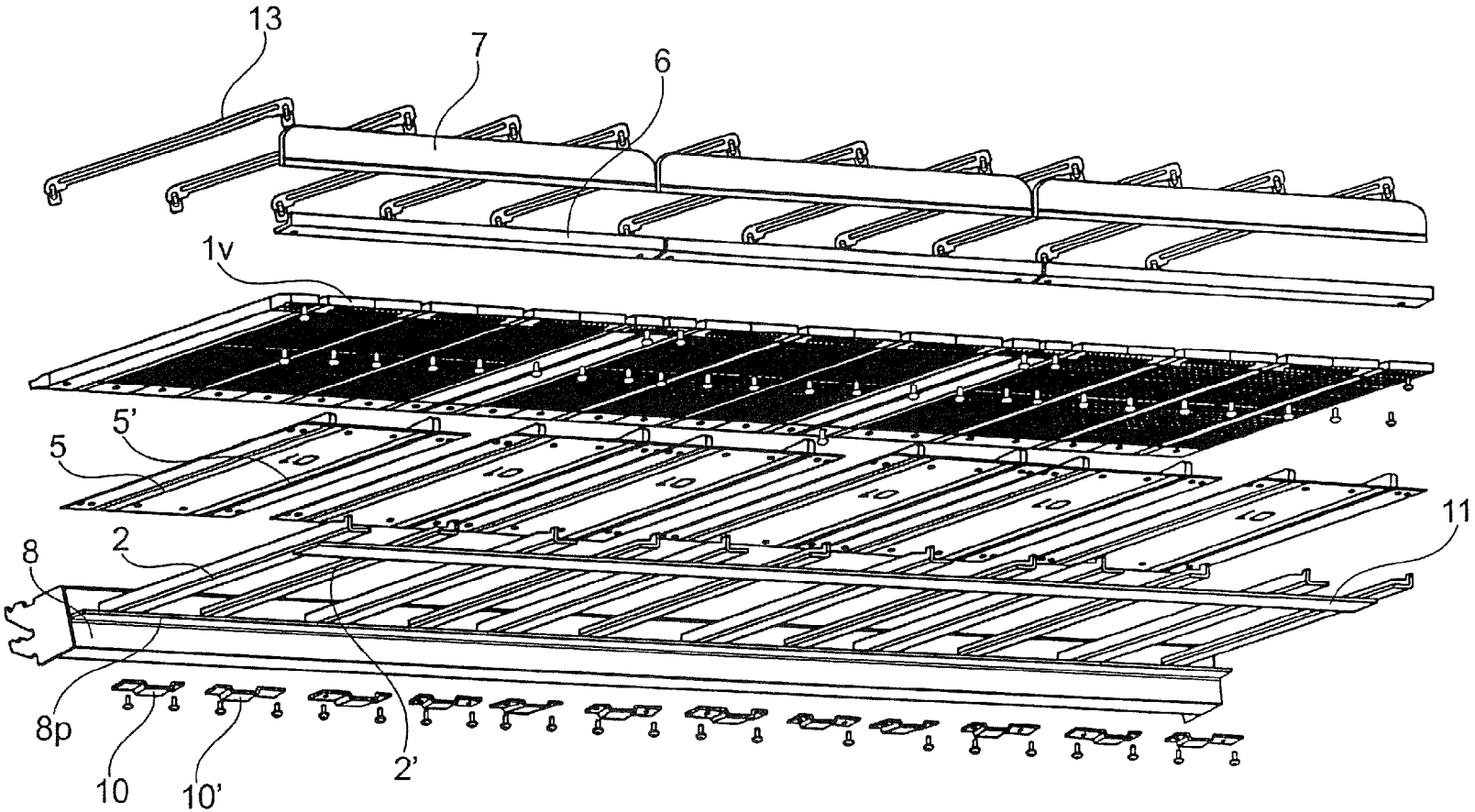
FIG. 2 shows a perspective exploded view of the goods feedings system according to the invention obliquely from below.
Figure 3:
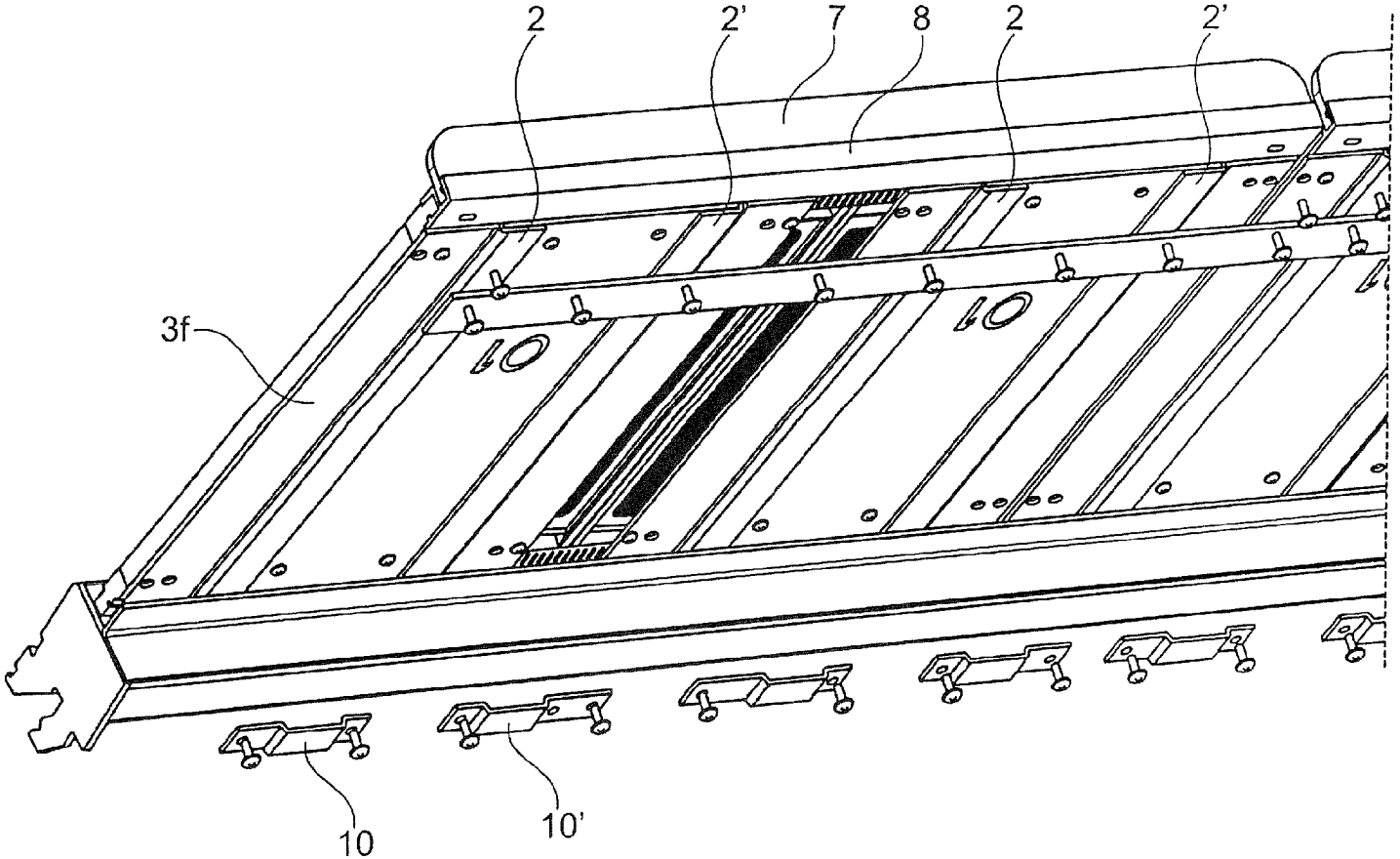
FIG. 3 shows a perspective view of the goods feeding system according to the invention in the mounting.

In FIG. 1, a carrier profile 8 is shown with a tie-bar 8*p* that extends essentially over the entire length of the carrier profile 8 for attaching guide rails 2, 2' and that can be mounted over lateral locking hooks 8*r* on a corresponding crossbar. A number of carrier profiles 8 can be arranged above one another along the height of the crossbar so that a frame system is produced. Instead of the tie-bar 8*p*, it is conceivable according to the invention to provide a profile groove for hooking the guide rails 2, 2' along the carrier profile 8. In the mounted state, the guide rails 2, 2' are tilted slightly downward relative to the horizontal from the carrier profile 8 up to one end 2*e*, 2*e'* of the guide rails 2, 2' so that automatic goods feeding of goods received in the goods feeding can take place. The tilting can be set by providing an angle of inclination of the guide rails 2, 2' relative to the carrier profile 8 or by tilted installation of the carrier profile 8 on the locking hooks 8*r* on the crossbars (not shown). The guide rails are attached in particular by welding on the tie-bar 8*p*.

The guide rails 2, 2' are designed as L-shaped profiles in cross-section, whereby in each case, a guide leg 2*s*, 2*s'* of the guide rails 2, 2' projects upward and an attaching leg 2*f*, 2*f'* is arranged in a plane that is parallel to the goods feeding attachments 1. The attaching legs 2*f*, 2*f'* of two related guide rails 2, 2' each face one another.

In the embodiment shown in FIG. 1, six pairs of guide rails 2, 2' are connected in the area of the ends 2*e*, 2*e'* by a cross-rail 11, in particular by welding. The carrier profile 8, the six pairs of guide rails 2, 2', and the cross-rail 11 form almost the stationary foundation for the goods feeding system.

One support surface 3 each that is slip-guided relative to the guide rails 2, 2' can be put on each pair of guide rails 2, 2'. The guiding of the support surfaces 3 is done by guide grooves 5, 5', which are suitable for receiving the guide legs 2*s*, 2*s'* by the latter being formed as profiling 4, 4' corresponding to the guide legs 2*s*, 2*s'*. The profiling 4, 4' can be produced simply and economically as a U-profile. The guide grooves 5, 5' are arranged on a guide side 3*f* of the support surfaces 3, with which the support surfaces 3 are put on the guide rails 2, 2'.

Opposite the guide side 3*f*, the support surfaces 3 have support surface sides 3*a* on which the goods feeding attachments 1 can be put.

In this way, the profilings 4, 4' are used simultaneously for attaching the goods feeding attachments 1 at least in a crosswise direction Q. The crosswise direction Q runs crosswise to a goods feeding direction W, formed by the support surface side 3*a*, along the profiling 4, 4'.

In the embodiment shown in FIG. 1, two goods feeding attachments 1 can be accommodated between the profilings 4, 4' of each support surface 3, and the support surfaces 3 in each case are designed laterally to the profilings 4, 4' in such a way that between adjacent support surfaces 3, two goods feeding attachments 1 can be accommodated. Thus, a flat roller field 12, which is formed by a number of rollers of the goods feeding attachments 1 and which is suitable for receiving and presenting goods, is produced. By providing an angle of inclination $\alpha$ to the horizontal, which drops from the carrier profile 8, an automatic forwarding is made possible by the weight of goods on the roller field 12 up to a front edge 1*v* of the goods feeding attachments 1.

The roller field 12 extends from the carrier profile 8 up to the front edge 1*v* over a support surface length L.

Figure 6:
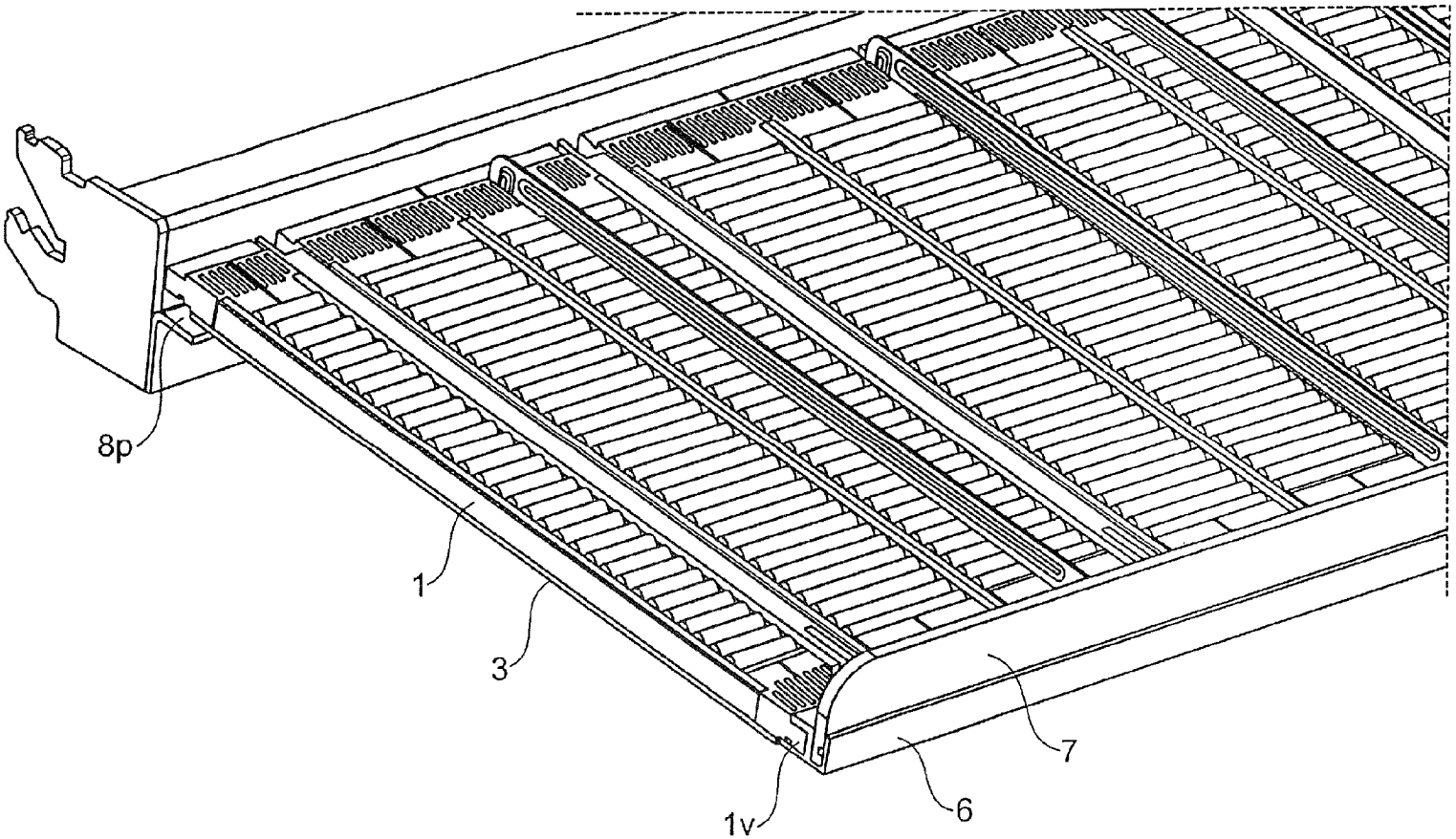
FIG. 6 shows a perspective view of the goods feeding system with a mounted section bar with a stop.

So that the goods that are accommodated on the roller field 12 do not fall down from the roller field 12, a section bar 6 (FIG. 6) can be clipped onto the front edge 1*v* of the goods feeding attachments, and said section bar is simultaneously used to hold several goods feeding attachments 1 on their front edges 1*v*. In this way, a group of goods feeding attachments 1, eight goods feeding attachments 1 in this embodiment, is formed. On the section bar 6, a stop 7 can be attached crosswise to the orientation of the goods feeding attachment 1, and said stop projects upward from the roller web. In this respect, the latter is used to hold goods that are accommodated on the roller field 12 on the front edge 1*v* and to be oriented there, so that the goods are arranged in one row and are easily visible on the front side of the frame.

For lateral attaching or orientation of the goods that are located on the roller field 12, rail profiles 13 can be inserted into the goods feeding attachments 1 at almost any point in the crosswise direction Q.

The support surfaces 3 are attached not only by the positive connection of the guide grooves 5, 5' with the guide legs 2*s*, 2*s'* to the guide rails 2, 2' in crosswise direction Q, but rather in addition are attached by attaching profiles 10, 10' with the guide rails 2, 2'. The attaching profiles 10, 10' are attached onto—in particular bolted on—the support surface side 3*a* from below, and in each case encompass one of the guide rails 2, 2' in such a way that the support surfaces 3 are prevented from being lifted from the guide rails 2, 2', but sliding along the guide rails 2, 2' in the goods feeding direction W remains possible. The attaching profiles 10, 10' can advantageously be produced as a profile from a plate.

At the same time, the attaching profiles 10, 10' perform another function, namely when the group that is formed by the section bar 6 is pulled out from goods feeding attachments 1 in the goods feeding direction W. Here, the attaching profiles 10, 10' are used as stops for limiting the pulling-out of the group from the goods feeding attachments 1, as is shown without goods feeding attachments in FIG. 4 and with goods feeding attachments 1 in FIG. 5.

Figure 4:
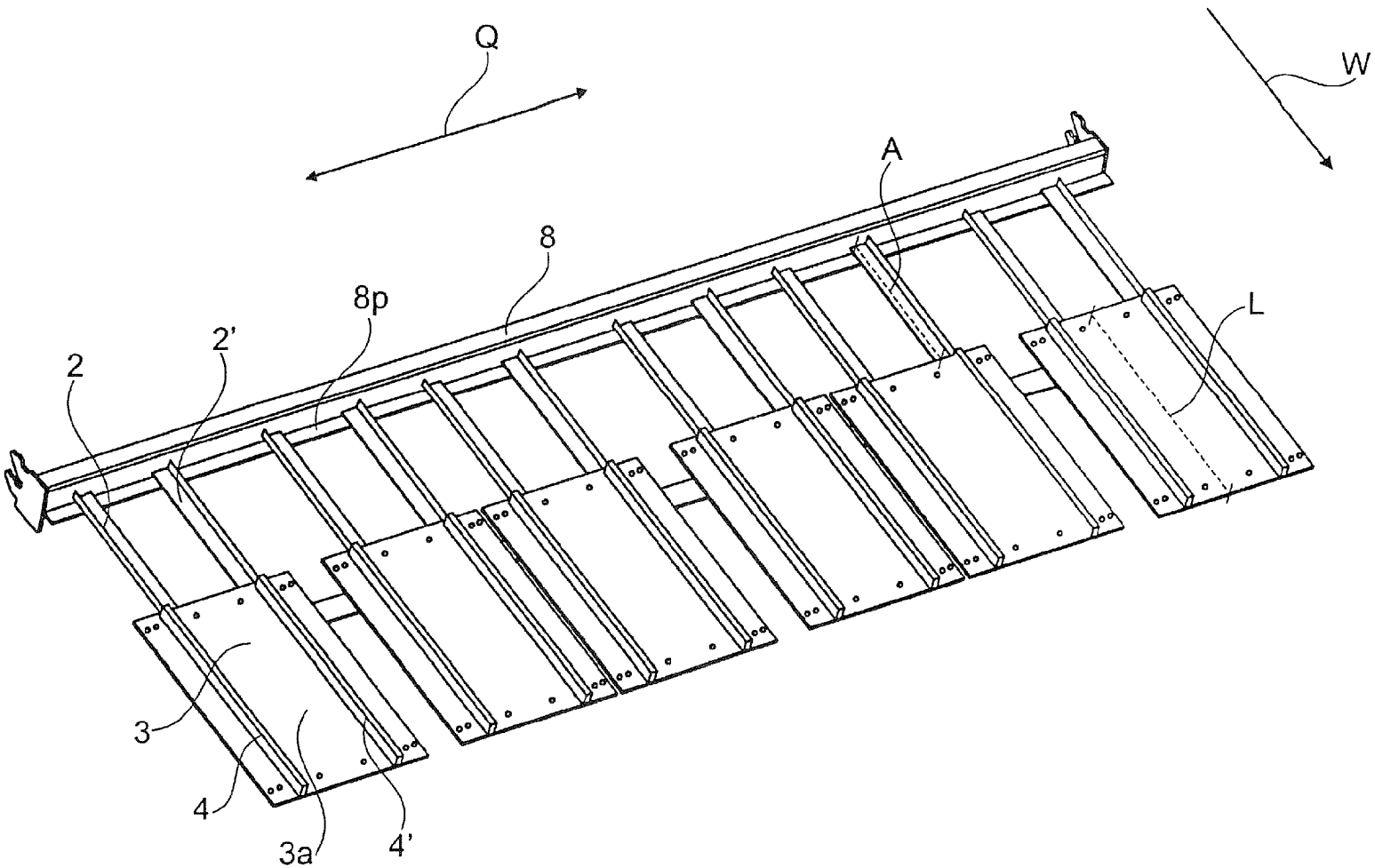
FIG. 4 shows a perspective view of the goods feeding system with a support surface that is pulled up.
Figure 5:
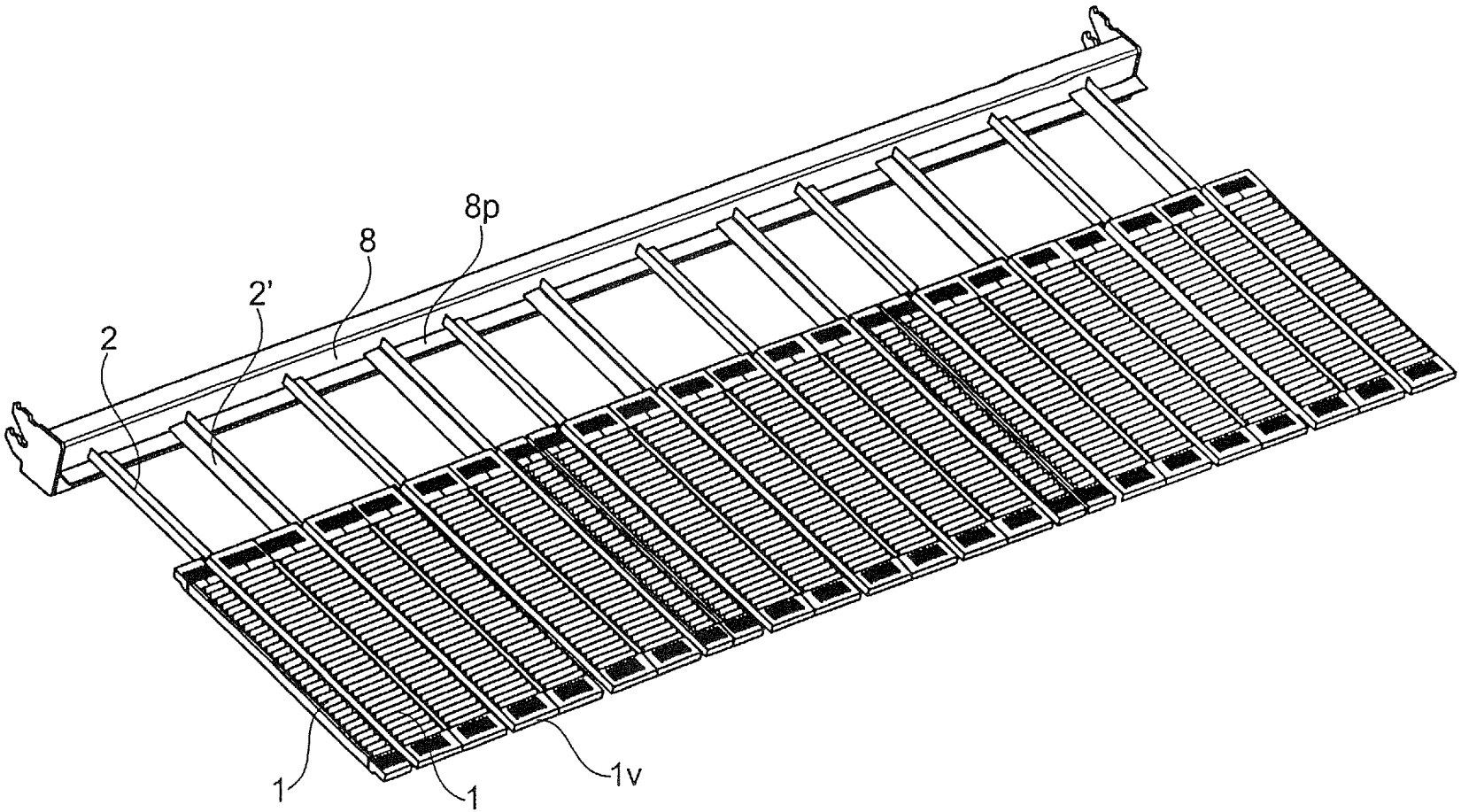
FIG. 5 shows a perspective view of the goods feeding system during insertion of goods feeding attachments.

In FIG. 4, it is shown that the support surface 3 or the goods feeding attachments 1 can be pulled out on the support surface 3 almost over the entire support surface length L along the goods feeding direction W, whereby the support surfaces 3 are slip-guided on the guide legs 2*s*, 2*s'*. The attaching profiles 10, 10' prevent the support surfaces 3 from tipping downward toward the front under the weight of the goods.

The pull-out length, by which the support surfaces 3 or the goods feeding attachments 1 can be pulled out in the goods feeding direction W, is defined by the attaching profiles 10, 10' and the cross-rail 11, which is used as a stop for the attaching profiles 10, 10'. A distance A between a completely inserted position of the support surfaces 3, which, in the four support surfaces 3, are arranged on the right in FIG. 4, is produced relative to the two completely pulled-out support surfaces 3, arranged on the left.

The ratio between the distance A and the support surface length L is in particular greater than 1 to 2, preferably greater than 2 to 3, more preferably greater than 3 to 4, and even more preferably greater than 5 to 6.

So that the goods feeding attachments or groups of goods feeding attachments 1 in the inserted position do not inadvertently automatically slide out because of the weight of the goods, a detent 9, 9' is provided at the ends 2*e*, 2*e'*, into which detent the support surfaces 3 lock in the retracted position. The detents 9, 9' project at the ends 2*e*, 2*e'* over the guide legs 2*s*, 2*s'* upward, by which the guide grooves 5, 5' are attached to their front sides 5*s*, 5*s'* by the detents 9, 9'. The locking connection can be overcome in a simple way by lifting the support surfaces 3 or the group of support surfaces 3 or the group of goods feeding attachments 1 and by pulling out the group of goods feeding attachments or support surfaces 3, but it prevents—also caused by the weight of the goods—an inadvertent pulling-out of the goods feeding attachments 1.

Having described the invention, the following is claimed:

1. Goods feeding system for receiving and presenting goods and for receiving goods feeding attachments for automatic forwarding of goods in a goods feeding direction W with a support surface for receiving and holding goods feeding attachments, whereby the goods feeding system has a support surface length (L) along the goods feeding direction (W), and the support surface can be pulled out at least partially along the support surface length (L) in the goods feeding direction (W), wherein the support surface on a support surface side has at least one, in particular two, profiling(s) for attaching the goods feeding attachments, in particular exclusively, in a direction (Q) that is crosswise to the goods feeding direction (W), and wherein the support surface on a guide side that faces away from the support surface side has at least one guide groove, formed in particular by the profiling, for receiving and guiding at least one corresponding guide rail in the goods feeding direction (W).

2. Goods feeding system according to claim 1, wherein a number of support surfaces are provided, which can be pulled out independently of one another.

3. Goods feeding system according to claim 1, wherein the support surfaces are designed in such a way that at least one goods feeding attachment can be accommodated between adjacent support surfaces.

4. Goods feeding system according to claim 1, wherein a number of support surfaces can be mounted in a profile groove, running in a crosswise direction (Q), in particular in each case by means of the guide rails.

5. Goods feeding system according to claim 1, wherein the support surface can be locked in an insertion position, in particular by at least one detent that is preferably provided at the guide rail.

6. Goods feeding system for receiving and presenting goods and for receiving goods feeding attachments for automatic forwarding of goods in a goods feeding direction W with a support surface for receiving and holding goods feeding attachments, whereby the goods feeding system has a support surface length (L) along the goods feeding direction (W), and the support surface can be pulled out at least partially along the support surface length (L) in the goods feeding direction (W), wherein the support surface on a support surface side has at least one, in particular two, profiling(s) for attaching the goods feeding attachments, in particular exclusively, in a direction (Q) that is crosswise to the goods feeding direction (W), and wherein the at least one profiling is designed in a U shape that is integral with the support surface, and said profiling extends in particular along the goods feeding direction (W) over at least half, and preferably the whole, support surface length (L).

7. Goods feeding system according to claim 6, wherein a number of support surfaces are provided, which can be pulled out independently of one another.

8. Goods feeding system according to claim 6, wherein the support surfaces are designed in such a way that at least one goods feeding attachment can be accommodated between adjacent support surfaces.

9. Goods feeding system according to claim 6, wherein a number of support surfaces can be mounted in a profile groove, running in a crosswise direction (Q), in particular in each case by means of the guide rails.

10. Goods feeding system according to claim 6, wherein the support surface can be locked in an insertion position, in particular by at least one detent that is preferably provided at the guide rail.

11. Goods feeding system for receiving and presenting goods and for receiving goods feeding attachments for automatic forwarding of goods in a goods feeding direction W with a support surface for receiving and holding goods feeding attachments, whereby the goods feeding system has a support surface length (L) along the goods feeding direction (W), and the support surface can be pulled out at least partially along the support surface length (L) in the goods feeding direction (W), wherein several adjacent goods feeding attachments and/or several adjacent support surfaces are connected to a group by a section bar, and wherein the section bar is arranged on the end of the support surface that lies in the goods feeding direction (W), and a stop that projects from the support surface side can be fixed onto the latter.

12. Goods feeding system according to claim 11, wherein a number of support surfaces are provided, which can be pulled out independently of one another.

13. Goods feeding system according to claim 11, wherein the support surfaces are designed in such a way that at least one goods feeding attachment can be accommodated between adjacent support surfaces.

14. Goods feeding system according to claim 11, wherein a number of support surfaces can be mounted in a profile groove, running in a crosswise direction (Q), in particular in each case by means of the guide rails.

15. Goods feeding system according to claim 11, wherein the support surface can be locked in an insertion position, in particular by at least one detent that is preferably provided at the guide rail.

* * * * *